United States Patent [19]

Fox et al.

[11] Patent Number: 4,674,959

[45] Date of Patent: Jun. 23, 1987

[54] PRESSURE-OPERATED VALVE, PARTICULARLY FOR A DOWNHOLE PUMP

[75] Inventors: Albert D. Fox, Novi; Douglas B. Owen, Rochester, both of Mich.

[73] Assignee: D. W. Zimmerman Mfg., Inc., Madison Heights, Mich.

[21] Appl. No.: 781,961

[22] Filed: Sep. 30, 1985

[51] Int. Cl.[4] ..... E21B 37/06

[52] U.S. Cl. ..... 417/244; 166/304; 417/394; 417/440; 417/478

[58] Field of Search ..... 166/304; 417/244, 394, 417/440, 478

[56] References Cited

U.S. PATENT DOCUMENTS

| | | | |
|---|---|---|---|
| 3,039,309 | 6/1962 | Vesper et al. | 417/394 X |
| 3,152,645 | 10/1964 | Abbott | 166/304 X |
| 3,297,083 | 1/1967 | Taylor | 166/304 X |
| 3,361,205 | 1/1968 | Waldron | 166/304 |
| 3,532,164 | 10/1970 | Enright | 417/440 |
| 4,011,906 | 3/1977 | Alexander et al. | 166/304 X |
| 4,158,530 | 6/1979 | Bernstein | 417/394 X |
| 4,224,993 | 9/1980 | Huckaby | 166/304 X |
| 4,468,175 | 8/1984 | Owen | 417/244 X |

*Primary Examiner*—Carlton R. Croyle

*Assistant Examiner*—T. W. Olds

*Attorney, Agent, or Firm*—Allen D. Gutchess, Jr.

[57] ABSTRACT

A pressure-operated valve is provided, particularly for use with a downhole pump of the fluid-driven, successive-stage, bladder type. Such a pump includes a plurality of pump and transfer modules. The pump modules have bladders which are operated by fluid, preferably gas, under pressure supplied through two separate internal passages in the modules to pump liquid upwardly through transfer modules. The pressure-operated valve is located below the bottom of the pump module and normally closes off the two gas passages. When gas under pressure above operating pressure is supplied through one of the passages, to establish a sufficient pressure differential between the passages, the valve opens to connect the passages. Heated gas can then be circulated to increase the temperature of internal oil passages extending through the modules to prevent paraffin formation. The two gas circuits can also be connected to enable removal of condensate. Periodic opening or closing of the valve to enable one of these operations for a predetermined length of time can be done automatically or manually utilizing the surface controls provided with the pumping system.

22 Claims, 13 Drawing Figures

PRESSURE-OPERATED VALVE, PARTICULARLY FOR A DOWNHOLE PUMP

This invention relates to a pressure-operated valve, particularly for use with a downhole pump.

The downhole pump is of the fluid-driven, successive-stage, bladder type as disclosed more fully in U.S. Pat. No. 4,468,175 of Douglas B. Owen, issued Aug. 28, 1984. Such a pump includes pump modules for pumping liquid, such as oil, upwardly and includes transfer modules for transferring the oil from one pump module to the next. Each of the modules, whether pump or transfer, includes an elongate housing having two internal fluid or gas passages and an oil passage. The pump modules also have bladders located around the internal passages to force the oil upwardly to the next module when gas under pressure from one of the internal passages is supplied to space on one side of the bladder, preferably the outside. The internal gas passages are connected between the modules in a manner to alternate compressing and expanding motions of the bladders of the successive pump modules.

The lower end portions of the two internal gas passages are normally closed off. However, a pressure-operated valve in accordance with the invention is employed below the bottom pump module to open when gas under pressure higher than operating pressure is supplied to one of the passages to establish the required shift open pressure differential which is higher than the normal pressure differential between the passages. The lower end portions of the two gas passages then communicate with one another. Heated gas then be circulated to increase the temperature of internal oil passages extending through the modules to prevent paraffin formation. Connecting the two gas circuits also enables the removal of condensate that may occur in some pump installations. This can be accomplished by direct circulation, through an atomizing nozzle, or by the operation of a pressure intensifier to inject the condensate into the well bore. Periodically opening and closing of the valve to enable one of the above operations for a specified length of time can be either automatic or manual, utilizing the surface control provided with the pumping system.

The pressure-operated valve according to the invention has a body with a chamber at one end portion and two gas passages communicate with the internal passages of the modules thereabove to receive gas under pressure from a remote source located above the ground. A pressure-operated valve spool has a closed position separating the passages and an open position in which the two passages can communicate with one another to connect the internal passages of the modules thereabove. The valve spool has an end extending into the chamber and is connected by toggle links to a pair of pivotally mounted levers which are urged closer together by a spring in contact with the opposite end of each lever. This arrangement is effective to urge the valve spool away from a position of the toggle links being in pivotal alignment, i.e. to urge the valve spool toward either the open or closed position. The opposite end of the valve spool extends through an enlarged portion of the second gas passage and further into a smaller portion of the first gas passage, of the above mentioned two gas passages, when in a closed position. This valve spool end extends only partly into the enlarged portion of said second gas passage when in the open position.

When the valve spool is in the open position, it will stay open until gas under sufficiently higher pressure is supplied to the enlarged portion of the second gas passage, such that the resulting unbalanced pressure force acting upon the valve spool exceeds the resultant opposite force applied by the spring. through the pivotal mounted levers and toggle links which urge the valve spool to remain in the fully open position, causing the spool to be urged to move through the position in which the toggle links are in pivotal alignment to the fully closed position. The pressure differential which causes the required resulting unbalanced pressure force, hence forth to be called the "shift-closed pressure differential;" may be brougnt about from the above ground pressure source through selective control of pressures within each of the two gas passages. The shift-closed pressure differential is effected through an increase in differential pressure from the second gas passage to the first gas passage, through either increasing pressure within the second gas passage or reducing pressure within the first gas passage, or a combination of both, this being made possible by a check valve in the second gas passage which closes to block the flow of gas toward the valve spool end, the enlarged portion of the second gas passage and the first gas passage. This higher pressure gas from the second gas passage is then diverted through a branch passage to the chamber, behind the valve spool, and, in combination with the lower pressure in the enlarged portion of the second gas passage and the first gas passage, is a pressure differential which, when it equals or exceeds the required shift-closed pressure differential, will cause the valve spool, through acting upon it, to shift to the fully closed position, as explained above.

Similarly, when the valve spool is in the fully closed position it will stay closed until a sufficiently high pressure differential acts upon it such as to cause a resulting unbalanced pressure force equal or exceeding the magnitude of and opposite in sense to the resulting spring force applied through the pivotallymounted levers and toggle links which acts to urge the spool to its fully closed position. This sufficiently high pressure differential, hence forth to be known as the "shift-open pressure differential", may be effected, since in the closed position the two gas passages do not communicate with each other, through the above ground system control by either increasing gas pressure in the first gas passage or reducing pressure in the second passage or a combination of both pressure changes.

While the pressure-operated valve is intended specificially for use with the downhole pump, it also has other potential applications where a valve is needed to be opened and closed by fluid under pressure supplied from a remote source without need for additional fluid lines, electrical wires for solenoid control, or other devices or means to control said valve.

It is, therefore, a principal object of the invention to provide a pressure-operated valve which can be selectively opened or closed by the application of fluid pressure supplied from a remotely-located source.

Another object of the invention is to provide a valve for use with a fluid-operated, successive-stage, bladder pump which can be selectively operated by gas from a source above the ground to connect or close off internal gas passages within the pump.

Yet another object of the invention is to provide a downhole pump with a pressure-operated valve to connect internal gas passages of the pump to enable condensate to be removed from the passages or to supply heated gas therethrough to heat the pump modules, for example.

Many other objects and advantages of the invention will be apparent from the following detailed description of a preferred embodiment thereof, reference being made to the accompanying drawings, in which.

Figure 1:
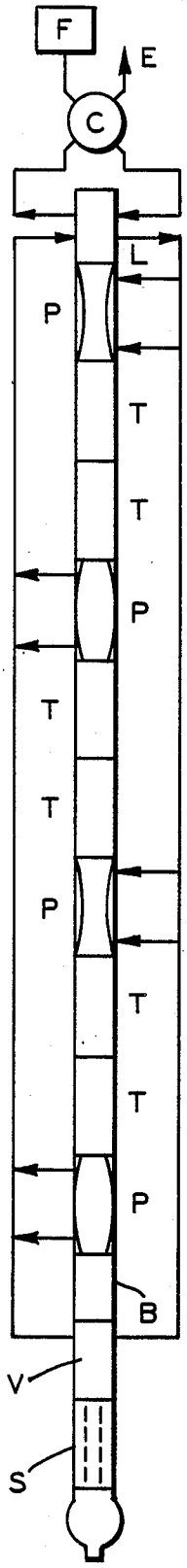
FIG. 1 is a diagrammatic view of a downhole pump embodying a pressure-operated valve in accordance with the invention.

The overall downhold pump in accordance with the invention is shown in FIG. 1. Pump modules which pump the oil or other liquid upwardly are designated "P" and transfer modules located between the pump modules and connecting them are designated "T". Fluid, preferably gas, under pressure is supplied to the pump modules "P", preferably to both ends thereof through two internal fluid lines, and the pump modules are also preferably exhausted at both ends through the fluid lines. For this purpose, a source of fluid under pressure is designated "F" above the surface of the ground and an exhaust vent "E" is also located above the surface, with the fluid source and the exhaust vent connected with the lines through a control valve "C" and a wellhead landing unit "L".

When fluid under pressure is supplied through internal fluid lines to alternate pump modules, flexible tubular members or bladders represented by the curved lines in those pump modules are compressed inwardly or squeezed to force oil therein upwardly to the next transfer module "T". When the gas is exhausted from the alternate pump modules "P", the bladders are allowed to expand to receive oil from the lower transfer modules "T", the oil being pumped upwardly by the next lower pump module "P". The oil is supplied through a filter sleeve "S", a recirculating or pressure-operated valve module "V" in accordance with the invention, and a bottomhole module "B".

Figure 2:
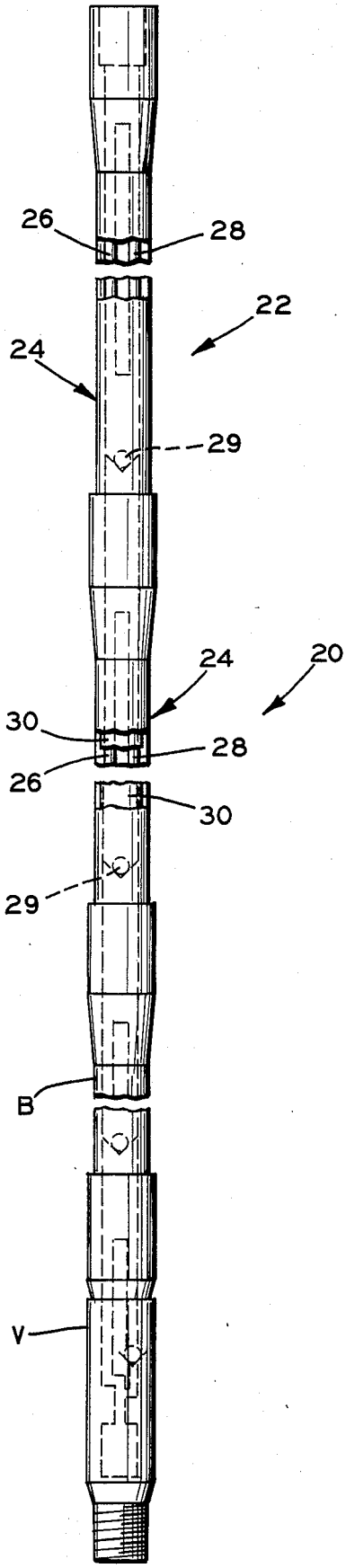
FIG. 2 is a schematic view, with parts broken away, of various modules, including a valve module, of FIG. 1.
Figure 3A:
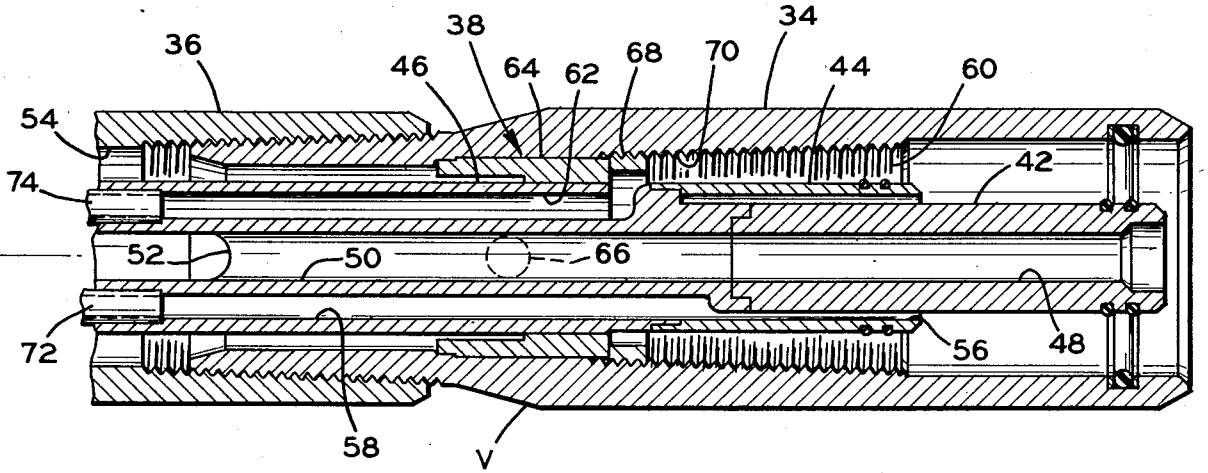
FIGS. 3A and 3B are enlarged, fragmentary views of the valve module, with parts broken away and with parts in section.
Figure 3B:
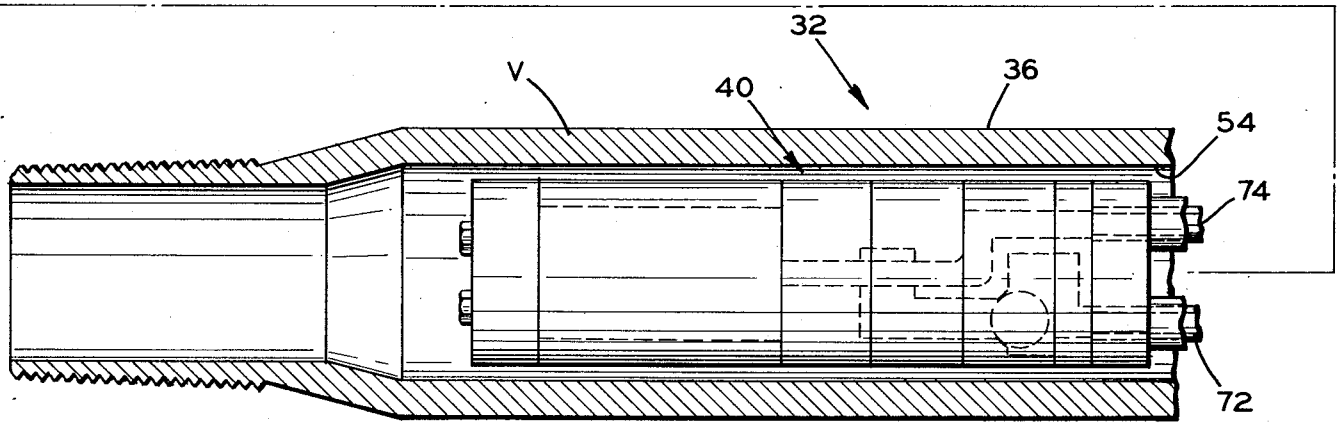

Referring to FIG. 2, a pump module 20 and a transfer module 22 are shown schematically in assembled relationship. The pump module 20 and the transfer module 22 each have an elongate tubular housing or production tubing 24 with lower and upper couplings. Each of the modules has first and second internal gas passages 26 and 28 extending between the couplings and a lower check valve 29 for the oil passage. The pump module 20 also has a flexible member or bladder 30 of simple tubular shape extending around the internal gas passages. The bottomhole module "B" also has internal gas passages and a check valve. The internal gas passages 26 and 28 communicate with passages in the pressure-operated valve module "V" which is shown more fully in FIGS. 3A and 3B.

The valve module "V" has a housing 32 with an upper part 34 and a lower part 36, the housing containing a coupling core 38 and a valve 40 in accordance with the invention. The coupling core 38 is similar to the core of FIG. 12 of the aforementioned U.S. Pat. No. 4,468,175. Its function is to connect passages in the valve 40 with the internal passages 26 and 28 of the modules above the valve module. The coupling core 38 includes an inner sleeve 42 and an outer sleeve 44 extending upwardly from a center core 46. The inner sleeve 42 forms a central oil passage 48 which communicates with a corresponding passage of the next module and also communicates with a central oil passage 50 in the center core 46. The passage 50, in turn, communicates through notches 52 with a chamber 54 in an upper portion of the lower housing part 36. An annular gas passage 56 is formed between the inner and outer sleeves 42 and 44 and communicates with a gas passage 58 in the center core 46. An outer gas passage 60 around the outer sleeve 44 communicates with a gas passage 62 in the center core 46. The passages 58 and 62 are oval-shaped in transverse cross section.

A support sleeve 64 is affixed to the center core 46 by pins 66 which extend through the wall of the sleeve 64 and into the core 46. When the support sleeve 64 is in place, a threaded ring 68 is turned into a threaded recess 70 to secure the sleeve. Both the core 38 and the valve 40 are supported through the sleeve 64 which rests on a shoulder in the housing part 34.

Figure 4:
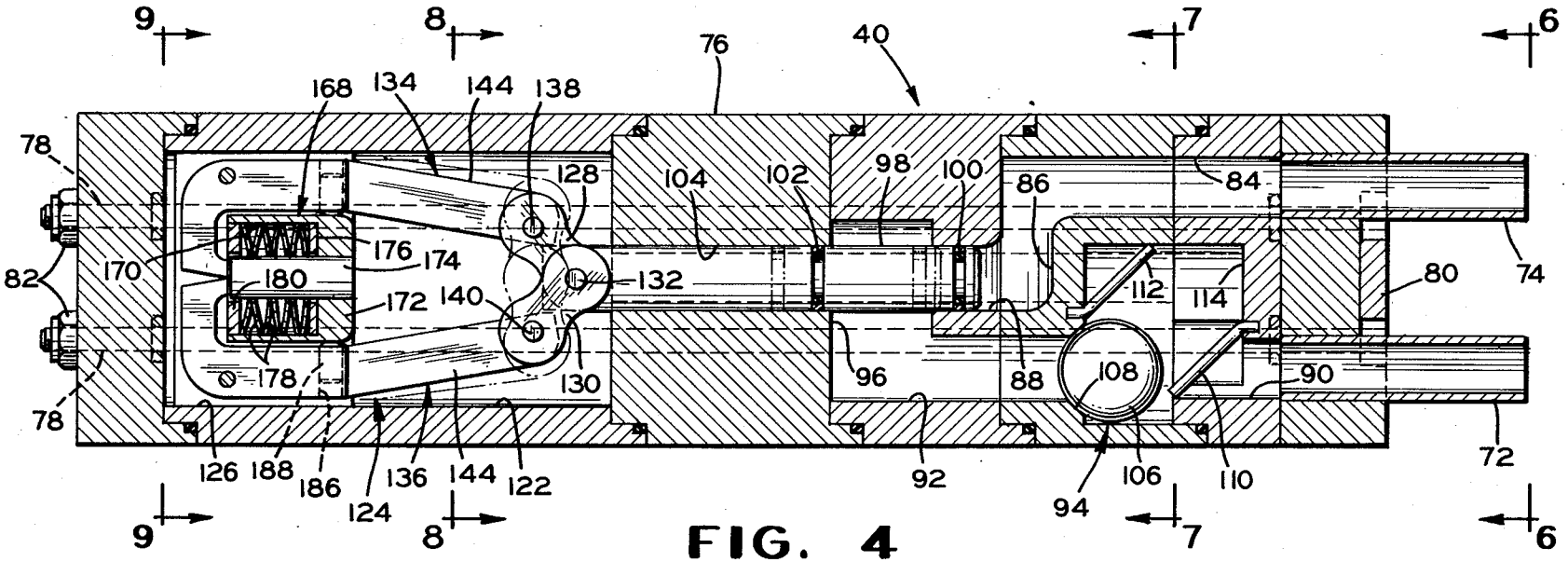
FIG. 4 is a further enlarged view in longitudinal cross section of a valve of the valve module.
Figure 6:
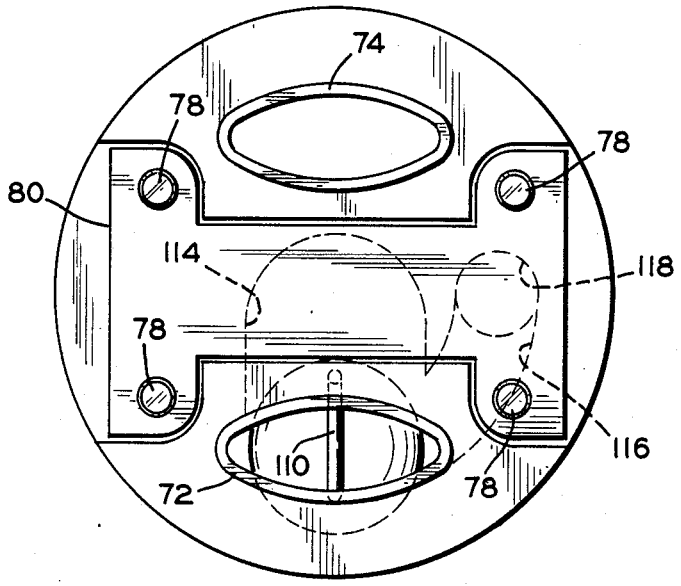
FIG. 6 is a further enlarged end view of the valve, taken along the line 6—6 of FIG. 4.
Figure 7:
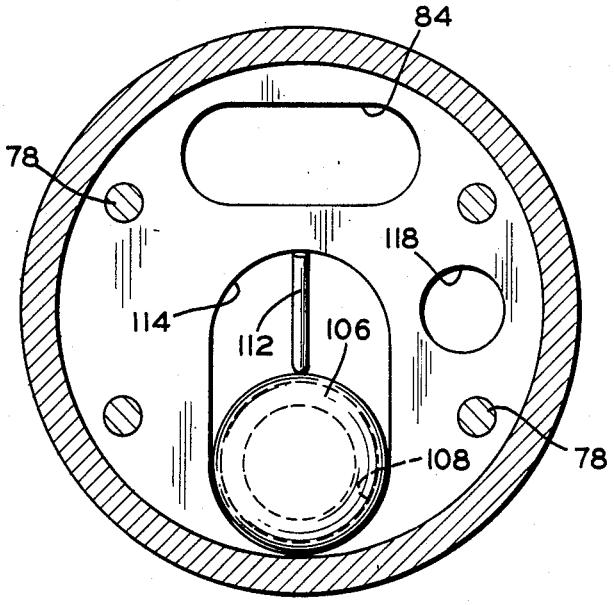
FIG. 7 is an enlarged view in transverse cross section taken along the line 7—7 of FIG. 4.

The lower end of the center core 46 is connected to the upper end of the valve 40 by nipples 72 and 74 which also are of oval shape in transverse cross section. Referring particularly to FIG. 4, the valve 40 comprises a multi-part housing 76 for manufacturing and assembly purposes. The housing parts have sealing rings and silicone coatings therebetween and are held together by threaded rods 78 with upper ends threaded into a recessed end plate 80 (FIG. 6) and lower ends threaded into nuts 82 (FIG. 4).

The nipple 74 communicates with a first longitudinallyextending passage 84 in the valve housing 76 having an offset passage 86 communicating with a valve passage 88. The nipple 72 communicates with second longitudinally-extending passages 90 and 92 having a check valve 94 therebetween, the passage 92 communicating with a valve chamber 96.

A valve member or spool 98 has spaced seals 100 and 102, each of which consist of an inner O-ring and an outer plastic glide ring. With the valve spool 98 in the closed position of FIG. 4, the seal 100 is in the valve passage 88 and the seal 102 is in a valve spool bore 104.

The check valve 94 includes a valve ball 106 and a valve seat 108. Fingers or pins 110 and 112 direct the valve ball 106 into a side chamber 114 when the ball 106 is off of the seat 108 to minimize flow resistance in the second passage 90 and 92.

Figure 8:
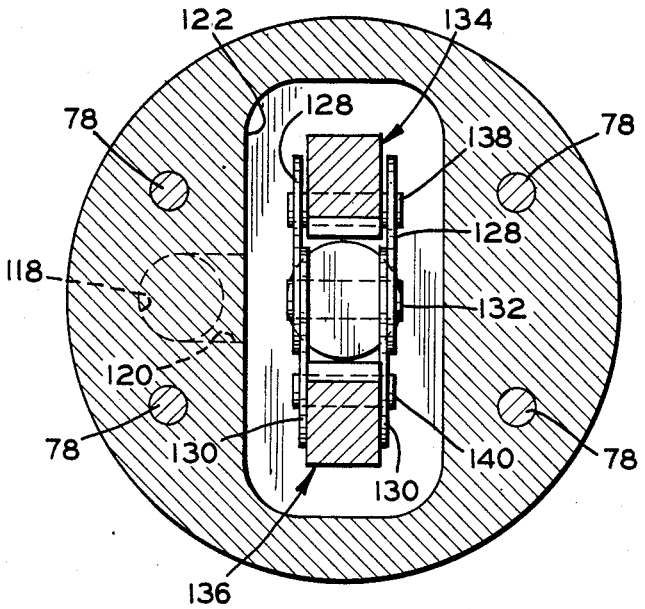
FIG. 8 is an enlarged view in transverse cross section taken along the line 8—8 of FIG. 4.

A branch passage 116 (FIG. 6) communicates with an upper portion of the side chamber 114 and extends to a third longitudinally-extending passage 118. The passage 118 communicates through a notch 120 (FIG. 8) with a narrower portion 122 of a back-pressure chamber 124 having a wider, lower portion 126.

An end of the valve spool 98 extends into the narrower portion 122 of the chamber 124 for all positions of the valve spool. This end is pivotally connected to ends of two pair of toggle links 128 and 130 by a suitable pin 132. The other ends of the toggle links 128 and 130 are connected to upper ends of L-shaped levers 134 and 136 by pins 138 and 140 extending through holes 142 in the upper ends (see also FIG. 10).

Figure 10:
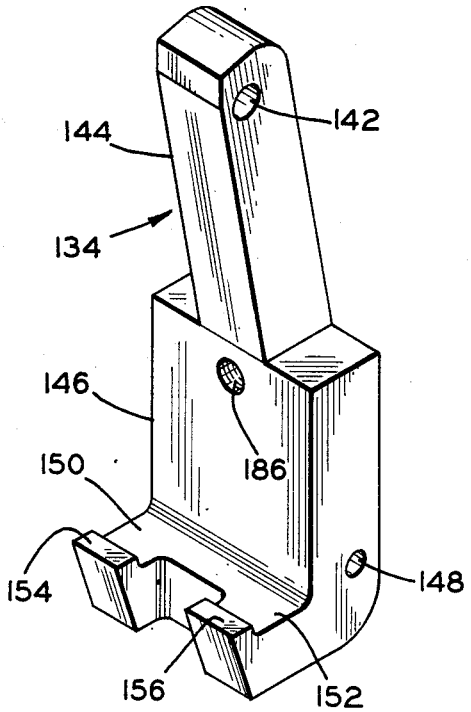
FIG. 10 is a view in perspective of a spring-loaded lever of the valve.

The L-shaped levers 134 and 136 are the same and the lever 134 is shown in FIG. 10. It includes a narrow upper end portion 144 having the hole 142 and a wide lower end portion 146 having a pivot bore 148 and terminating in right-angle legs 150 and 152 having upturned feet or flanges 154 and 156.

Figure 9:
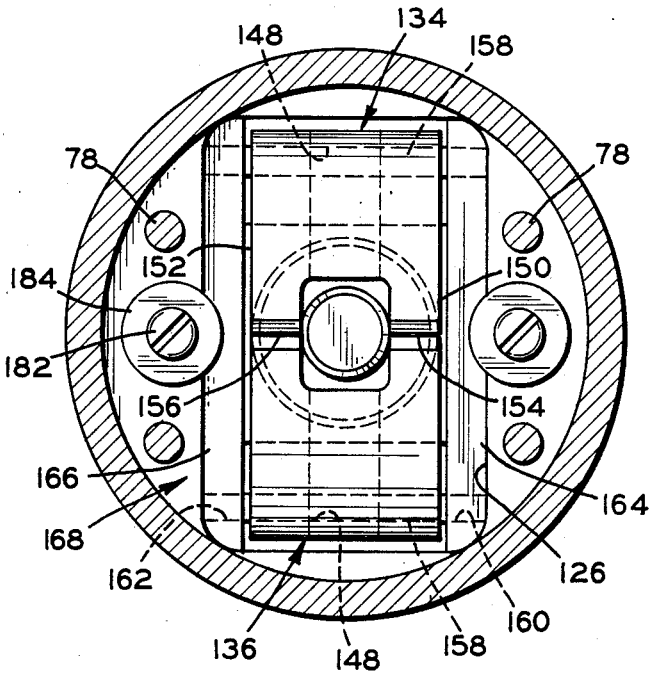
FIG. 9 is an enlarged view in transverse cross section taken along the line 9—9 of FIG. 4.
Figure 11:
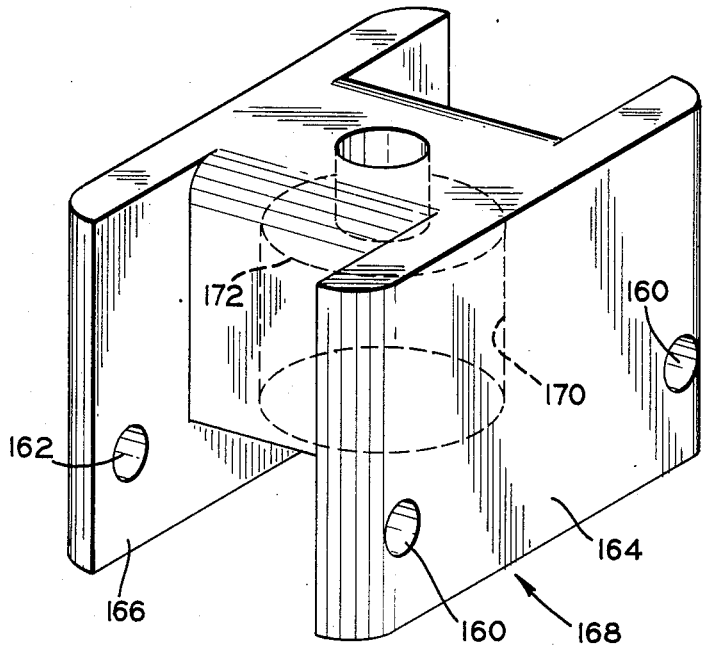
FIG. 11 is a view in perspective of a mounting member of the valve.

Referring to FIGS. 9 and 11, the L-shaped levers 134 and 136 are pivotally mounted by pins 158 extending through the bores 148 and into holes 160 and 162 in side plates 164 and 166 of a mounting member 168. The member 168 has a cylindrical chamber 170 with an end wall 172 from which a guide post 174 extends through an open end of the chamber 170. A contact washer 176 is located adjacent the end wall 172 and a plurality of spring washers 178 are located in back-to-back relationship within the chamber 170 around the post 174. A heavier contact washer 180 is located at the open end of the chamber 170 adjacent the spring washers 178. The mounting member 168 is held in the wider chamber 126 by screws 182 (FIG. 9) and washers 184. Various other types of springs can be used in place of the spring washers 178.

Referring to FIGS. 4 and 10, the levers 134 and 136 have threaded bores 186 therein which receive set-screws 188. The set-screws are turned into the bores 186 to engage the edge surface of the end wall 172 to determine the innermost positions of the upper end portions 144 of the levers 134 and 136. These positions should be symmetrical with respect to the center line of the valve spool 98 to minimize any transverse forces on the valve spool 98 to avoid binding in the bore 104 and the passage 88.

Figure 5:
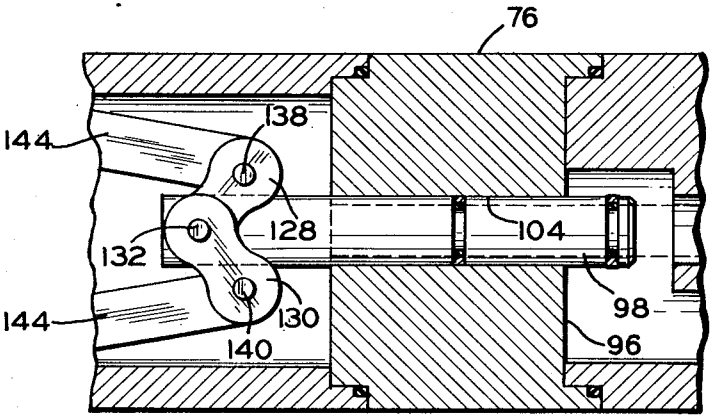
FIG. 5 is a fragmentary view in longitudinal cross section of certain components of the valve of FIG. 4 shown in different positions.

In operation, when there is sufficient gas pressure in the longitudinal passage 84 or, more precisely, a sufficient pressure differential between the gas pressures in the passage 84 and the chamber 122, the valve spool 98 will be pushed into the chamber 122 from the closed position shown in solid lines in FIG. 4, to a fully open position shown in solid lines in FIG. 5. With the valve spool 98 in the closed position, the end portions 144 of the levers 134 and 136 are in their closest positions with the toggle links 128 and 130 slanting toward the valve spool. When the pressure acting on the valve spool 98 is sufficient, it spreads apart the levers 134 and 136 with the spring washers 178 being compressed as the feet 154 and 156 of the levers force the contact washer 180 toward the end wall 172. As the valve spool 98 moves toward an intermediate position in which the toggle links 128 are in alignment with the toggle links 130, the force required to move the valve spool 98 toward the open position diminishes rapidly. When the valve spool and links move and links move beyond the intermediate position, the force of the levers 134 and 136, which seek to move toward their closest position, then move the valve spool to the fully open position of FIG. 5.

With this mechanical linkage or arrangement, when the end of the valve spool 98 with the seal 100 moves out of the valve passage 88, the toggle linkages and levers will have moved beyond the intermediate middle position and the valve spool will be moved to its fully open position. This will occur even if the pressure differential between the gas in the passage 84 the chamber 122 drops rapidly after the valve spool 98 clears the valve passage 88. The valve spool will then remain open while gas is passed through the internal passages of the modules thereabove and through the passages 84 and 92. This gas can be used to blow condensate out of the module internal passages. Also, heated gas can be passed through these passages to heat the modules and melt any paraffin buildup in the oil passages.

When gas is supplied through the passage 90, it will close the valve ball 106 on the seat 108. The gas will then flow through the branch passage 116 (FIG. 6), through the third longitudinal passage 118, and into the narrow chamber 122. When the pressure of the gas in the passage 90 and in the chamber 122 exceeds the pressure in the passage 84 and the chamber 96 sufficiently, the pressure in the chamber 122 acting on the lower end of the valve spool 98 will then cause the valve spool to move through the intermediate position and to the closed position shown in solid lines in FIG. 4. The valve spool then remains closed until a pressure differential sufficient to open it again exists across the passage 84 and the chamber 122.

The pressure differential which will cause the valve to open or close depends on the initial compression of the springs as well as the selection of the spring washers 178 and the angle of the toggle links 128 and 130 relative to one another. The pressure differential which will cause the valve to open or close is selected to be above the operating pressure of the pump. Typically, when a differential pressure of 100 PSI is the operating pressure, the valve will be caused to open or close at a pressure differential of 150 PSI.

Figure 12:
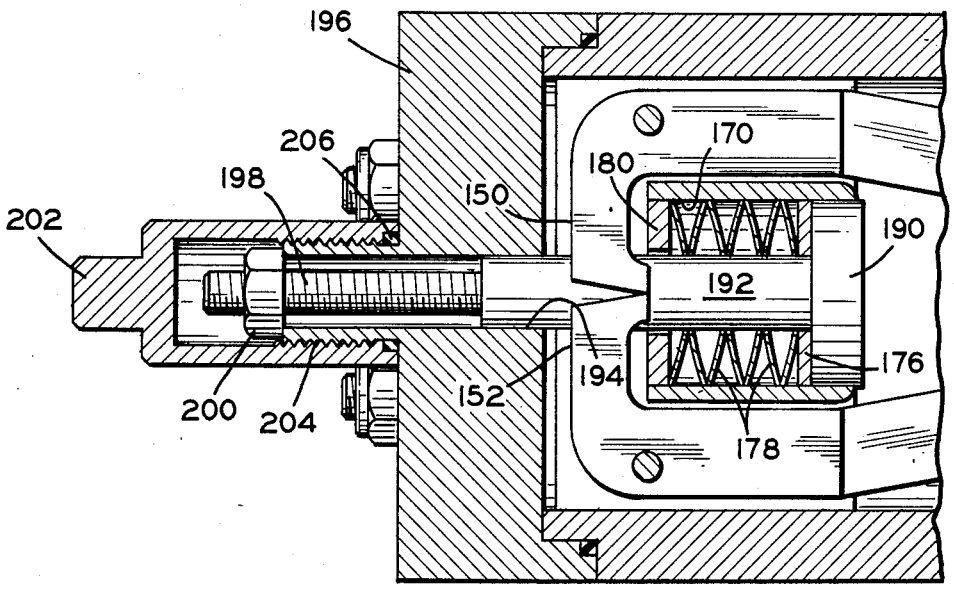
FIG. 12 is a fragmentary view in longitudinal cross section of a modification of the valve.

FIG. 12 shows a modification in which the pressure differential required to open or close the valve can be varied by varying the compression on the spring washers 178. This modification is the preferred embodiment in many applications. In this instance, a moveable end wall 190 is employed at the end of the cylindrical chamber 170 in place of the fixed end wall 172 of FIG. 11. The end wall 190 is affixed to a guide post 192 which extends beyond the washers 176 and 180, between the legs 150 and 152 of the levers 134 and 136, and through a bore 194 in an end wall 196 of the valve housing 76. The post has a threaded shank 198 extending therefrom beyond the outer surface of the end wall 196 and an external nut 200 is received on the shank 198. A cap 202 protects the nut and shank and is received on a threaded protrusion 204 of the end wall 196 with a seal 206 therebetween. The nut 200 can be turned further on to the shank 198 to increase the compressive force on the spring washers 178. A greater pressure differential in the gas passages then is required to cause the valve spool 98 to open or close. Similarly, the nut 200 can be turned in the opposite direction on the shank 198 to decrease the compressive force on the spring washers 178 and thereby decrease the pressure differential required to open or close the valve spool.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A liquid pump for use in a well including a pump module having a housing with an upper end and a lower end, said valve module having a chamber, first passage-forming means forming a first gas passage extending between the ends of said module, second passage-forming means forming a second gas passage extending between the ends of said module, means for supplying gas under pressure alternately to said first and second gas passages, a valve module below said pump module, said valve module having first passage means communicating with said first gas passage, second passage means communicating with said second gas passage, third gas passage means communicating between said second gas passage means and said chamber, a pressure-operated valve member in said valve module having a closed position closing communication between said first and second passage means when the pressure differential of gas in said first and second passage means is not above a predetermined pressure differential and having an open position enabling communication between said first and second passage means when the pressure differential of gas in said first and second passage means is above a predetermined pressure differential, and a check valve in said second gas passage means between said valve member and said third gas passage means.

2. A liquid pump according to claim 1 characterized by said check valve preventing the flow of gas in said second gas passage means toward said valve member.

3. A liquid pump according to claim 2 characterized by means in said chamber urging said valve member toward the closed position when in the closed position and urging said valve member toward the open position when in the open position.

4. A liquid pump according to claim 1 characterized by toggle link means pivotally connected to said valve member, lever means pivotally connected to said toggle link means, and resilient means acting on said lever means in a manner tu urge said valve member toward the closed position when in the closed position and to urge said valve member toward the open position when in the open position.

5. A liquid pump according to claim 4 characterized by adjusting means adjustable from outside said valve module for changing the force of said resilient means on said lever means.

6. A liquid pump according to claim 4 characterized by said resilient means comprising a plurality of spring washers acting on an end portion of said lever means, and means adjustable externally of said valve module for changing the amount of compression of said spring washers.

7. A liquid pump according to claim 1 characterized by two levers pivotally mounted in said chamber and symmetrically positioned with respect to a center line of said valve member, link means pivotally connecting end portions of said levers to said valve spool, and resilient means acting on other end portions of said levers in a manner to urge said valve member toward the closed position when in the closed position and to urge said valve member toward the open position when in the open position, the force necessary to move said valve member when in intermediate positions being less then that needed when in its open and closed positions.

8. A liquid pump according to claim 7 characterized by means for adjusting the closest positions said levers are to one another when the valve member is in the open and closed positions.

9. A liquid pump for use in a well including a pump module and a valve module below said pump module, said valve module having first passage means and second passage means, said valve module having a chamber, a pressure-operated valve spool in said valve module having one end closing off said first passage means when in a closed position and enabling communication between said first passage means and said second passage means when in an open position, said valve spool having a second end extending into said chamber, a check valve in said second passage means having a closed position preventing flow of gas through said second passage means toward said valve spool, and having an open position enabling the flow of gas through said second passage means from said first passage means, third passage means connecting said chamber with said second passage means on the side of said check valve opposite said valve spool, and means connected to the second end of said valve spool for urging said valve spool toward the closed position when in the closed position and for urging said valve spool toward the open position when in the open position, and means for supplying gas under pressure to said first and second passage means.

10. A liquid pump according to claim 9 characterized by said urging means further comprising a spring-loaded lever and link means connecting said lever and said valve spool in a manner such that the force required to move the valve spool when in its open or closed position is greater than when said valve spool is in an intermediate position between the open and closed positions.

11. A liquid pump according to claim 10 characterized by means extending outside of said valve module for changing the spring loading of said lever.

12. A liquid pump according to claim 9 characterized by said urging means comprising two levers pivotally mounted in said module and symmetrically positioned with respect to a center line of said valve spool, link means in said chamber pivotally connecting portions of said levers with an end portion of said valve spool, and resilient means acting on spaced portions of said levers.

13. A liquid pump according to claim 12 characterized by means for adjusting the closest positions said levers are to one another when the valve spool is in the open and closed positions.

14. A valve according to claim 11 characterized by said levers being of L-shaped configuration.

15. A valve according to claim 12 characterized by said resilient means comprising spring-washers, and means extending out of said chamber for adjusting the amount of compression on said spring washers.

16. A valve according to claim 13 characterized by said levers being positioned in said chamber symmetrically with respect to a center line of said valve spool, and means for adjusting the closest positions said levers are to one another when said valve spool is in the open and closed positions.

17. A valve according to claim 14 characterized by said links connecting said levers in a manner such that the force required to move said valve spool when in its open or closed position is greater than when said valve spool is in an intermediate position between its open and closed positions.

18. A liquid pump according to claim 1 characterized by said valve member also being moved to the closed position from the open position when the pressure differential from said second passage means to said first passage means exceeds a predetermined value, and said valve member also being moved to the open position from the closed position when the pressure differential from said first passage means to said second passage means exceeds a predetermined value.

19. A liquid pump according to claim 18 characterized by said valve member, when in the open position, remaining in the open position as long as the pressure differential from said second passage means to said first passage means does not exceed a predetermined value.

20. A liquid pump according to claim 19 characterized by said valve member, when in the closed position, remaining in the closed position as long as the pressure differential from said first passage means to said second passage means does not exceed a predetermined value.

21. A pressure-operated valve capable of being opened and closed by fluid under pressure supplied from a remote source, and valve comprising a valve body having first gas passage means and second gas passage means, said valve body having a chamber therein, a pressure-operated valve spool in said valve body having one end closing off said first passage means when in a closed position and enabling communication between said first passage means and said second passage means when in an open position, said valve spool having a second end extending into said chamber, a check valve in said second passage means having a closed position preventing flow of gas through said second passage means toward said valve spool, and having an open position enabling the flow of gas through said second passage means from said first passage means, third passage means connecting said chamber with said second passage means on the side of said check valve opposite said valve spool, and means connected to the second end of said valve spool for urging said valve spool toward the closed position when in the closed position and for urging said valve spool toward the open position when in the open position.

22. A pressure-operated valve according to claim 21 characterized by said urging means comprising two levers in said chamber, means pivotally supporting intermediate portions of said levers in said chamber, links pivotally connecting first ends of said levers to said second end of said valve spool, and resilient means engaging second ends of said levers in a manner to urge the first ends of said levers toward one another.

* * * * *

UNITED STATES PATENT AND TRADEMARK OFFICE

CERTIFICATE OF CORRECTION

PATENT NO. : 4,674,959

DATED : June 23, 1987

INVENTOR(S) : Albert D. Fox & Douglas B. Owen

It is certified that error appears in the above-identified patent and that said Letters Patent is hereby corrected as shown below:

In the specification:

Column 1, line 33, after "gas" should be --can--.

Column 2, line 42, "pivotallymounted" should be --pivotally-mounted--.

Column 4, line 54, "lyextending" should be --ly-extending--.

Column 5, line 41, "set-screws" should be --setscrews--.

In the claims:

Claim 4, line 5, "tu" should be --to--.

Claim 14, line 1, "11" should be --22--.

Claim 15, line 1, "12" should be --22--.

Claim 16, line 1, "13" should be --22--.

Claim 17, line 1, "14" should be --22--.

Signed and Sealed this

Third Day of November, 1987

*Attest:*

DONALD J. QUIGG

*Attesting Officer*

*Commissioner of Patents and Trademarks*